US008479517B2

(12) United States Patent
Uehara

(10) Patent No.: US 8,479,517 B2
(45) Date of Patent: Jul. 9, 2013

(54) VAPOR POWER CYCLE APPARATUS

(76) Inventor: Haruo Uehara, Saga (JP)

( * ) Notice: Subject to any disclaimer, the term of this patent is extended or adjusted under 35 U.S.C. 154(b) by 359 days.

(21) Appl. No.: 12/734,193

(22) PCT Filed: Feb. 10, 2010

(86) PCT No.: PCT/JP2010/051979
§ 371 (c)(1),
(2), (4) Date: Apr. 16, 2010

(87) PCT Pub. No.: WO2010/137360
PCT Pub. Date: Dec. 2, 2010

(65) Prior Publication Data

US 2011/0167826 A1 Jul. 14, 2011

(30) Foreign Application Priority Data

May 25, 2009 (JP) ..... 2009-125358

(51) Int. Cl.
*F01K 25/00* (2006.01)

(52) U.S. Cl.
USPC ..... 60/671; 60/649; 60/651; 60/673

(58) Field of Classification Search
USPC ..... 60/649, 673
See application file for complete search history.

(56) References Cited

U.S. PATENT DOCUMENTS

| | | | | |
|---|---|---|---|---|
| 5,588,297 | A * | 12/1996 | Uehara et al. | 60/673 |
| 6,539,717 | B2 * | 4/2003 | Kitz | 60/641.2 |
| 6,694,740 | B2 * | 2/2004 | Nayar | 60/651 |
| 6,898,936 | B1 * | 5/2005 | Ochs et al. | 60/649 |
| 6,910,334 | B2 * | 6/2005 | Kalina | 60/651 |
| 7,197,876 | B1 * | 4/2007 | Kalina | 60/649 |
| 7,347,049 | B2 * | 3/2008 | Rajendran et al. | 60/649 |

FOREIGN PATENT DOCUMENTS

JP 07-091361 A 4/1995

* cited by examiner

*Primary Examiner* — Thomas Denion
*Assistant Examiner* — Philip Eklem
(74) *Attorney, Agent, or Firm* — Rader, Fishman & Grauer PLLC

(57) ABSTRACT

A vapor power cycle apparatus that mixes part of high-temperature liquid-phase working fluid separated from a liquid-phase portion in a gas/liquid separator with high-temperature gas-phase working fluid extracted from a expander and allows the fluid to exchange heat with low-temperature liquid-phase working fluid from a condenser so as to efficiently recover the heat of working fluid and improve thermal efficiency of the entire cycle. The part of high-temperature liquid-phase working fluid separated from the liquid-phase portion in the gas/liquid separator is extracted, the resultant fluid is mixed in a second absorber with high-temperature gas-phase working fluid extracted from an interstage point in the expander to allow liquid-phase working fluid to absorb part of gas-phase working fluid and the high-temperature working fluid is used to heat low-temperature liquid-phase working fluid in a first heater without passing an extracted portion of high-temperature liquid-phase working fluid through a condenser.

2 Claims, 4 Drawing Sheets

VAPOR POWER CYCLE APPARATUS

TECHNICAL FIELD

The present invention relates to a vapor power cycle apparatus in which working fluid that is mixed medium of materials having different boiling points is circulated while heated and cooled to repeat phase changes thereby causing the working fluid to perform mechanical work to generate power.

BACKGROUND ART

For operating vapor power cycle with excellent efficient thermal efficiency and effective heat-to-power conversion, using high-temperature heat source and low-temperature heat source having a small heat difference, a vapor power cycle has been proposed that uses as a working fluid a mixed medium of water and a fluid having a lower boiling point than water or a mixed medium of fluid materials each having a lower boiling point than water. For example, Japanese Patent laid-Open No. 7-91361 describes such a conventional vapor power cycle system.

The conventional vapor power cycle system has a configuration similar to a typical Rankine cycle for effecting vapor power cycle, and comprises an evaporator, an expander (turbine), a condenser and a compressor (pump), as well as a gas/liquid separator for separating working fluid heated in the evaporator into gas-phase working fluid and liquid-phase working fluid, an absorber which causes liquid-phase working fluid to absorb part of gas-phase working fluid after expansion at a previous stage of the condenser, a regenerator which causes to liquid-phase working fluid taken from working fluid heated in the evaporator to perform heat-exchange with low-temperature and liquid-phase working fluid before heat-exchange in the evaporator, and a heater which causes high-temperature and liquid-phase working fluid extracted from between the expander stages to perform heat-exchange with low-temperature and gas-phase working fluid.

The conventional vapor power cycle system has advantages that it can provide a higher thermal efficiency than common Rankine cycles that use a single working fluid, and particularly that the expander is extracted and the absorber causes part of gas-phase working fluid to be absorbed in liquid-phase working fluid to reduce the amount of the gas-phase working fluid heat-exchanging with the low-temperature heat source in the condenser, thereby achieving a reduced load on the condenser and an increased efficiency of the whole system and eliminating the requirement for too large-sized a condenser and the associated cost increase.

CITATION LIST

Patent Literature

Patent Literature 1: Japanese Patent laid-Open No. 7-91361

SUMMARY OF INVENTION

Technical Problem

Using the conventional vapor power cycle system, having the configuration described in the above patent literature, the load on the condenser can be lowered due to the extraction from the expander, and the efficiency of the whole cycle can be increased by recovering the heat of the extracted gas-phase working fluid by heat-exchange with liquid-phase working fluid in the heater. The system, however, has a problem that the entire volume of the liquid-phase working fluid separated in the gas/liquid separator reaches the condenser to perform heat-exchange with the low-temperature heat source, which necessitates an ensured certain heat-exchange capacity of the condenser, leading to a limitation on size reduction of the condenser.

Another problem is poor heat utilization that the heat energy of liquid-phase working fluid separated in the gas/liquid separator, after partially transferring to low-temperature working fluid in the regenerator, is all discharged to the outside by heat-exchange with the low-temperature heat source in the absorber and condenser.

The present invention is made to solve the above problems. It is an object of the present invention is to provide a vapor power cycle apparatus in which high-temperature and liquid-phase working fluid separated from the gas-phase working fluid in a gas/liquid separator in a power cycle is partially extracted; the extracted working fluid is mixed with high-temperature and gas-phase working fluid extracted from between expander stages; the resultant fluid is used to heat low-temperature and liquid-phase working fluid after exiting the condenser, thereby achieving efficient recovery of the heat of high-temperature and liquid-phase working fluid and increase in thermal efficiency of the whole cycle.

Solution to Problem

A vapor power cycle apparatus according to the present invention includes at least:

an evaporator for allowing working fluid to exchange heat with a predetermined high-temperature heat source and for evaporating at least part of the working fluid, the working fluid including a plurality of materials each having different boiling point mixed with each other;

a gas/liquid separator for separating high-temperature working fluid obtained from the evaporator into a gas-phase portion and a liquid-phase portion;

an expander that receives the gas-phase portion of high-temperature working fluid for converting heat energy of the fluid into power;

a condenser for allowing high-temperature gas-phase working fluid from the expander to exchange heat with a predetermined low-temperature source along with the liquid-phase portion from the gas/liquid separator; and a compressor for compressing working fluid from the condenser and directing the fluid to the evaporator, the expander including a plurality of expansion stages, and part of high-temperature gas-phase working fluid being extracted from one or more interstage points, the vapor power cycle apparatus further including:

a regenerator for allowing high-temperature liquid-phase working fluid separated in the gas/liquid separator to exchange heat with working fluid flowing from the compressor toward the evaporator;

a first absorber for combining high-temperature gas-phase working fluid from a last stage of the expander with part of high-temperature gas-phase working fluid flowing through the regenerator from the gas/liquid separator, and for allowing high-temperature liquid-phase working fluid to absorb the part of high-temperature gas-phase working fluid and directing the fluid to the condenser;

a second absorber for combining the rest of high-temperature gas-phase working fluid flowing through the regenerator with at least part of high-temperature gas-phase working fluid extracted from the expander, and for allowing high-temperature liquid-phase working fluid to absorb the part of high-temperature gas-phase working fluid; and a heater for allowing high-temperature gas-phase and liquid-phase working fluid flowing through the second absorber to exchange heat with working fluid from the condenser.

According to the present invention, the part of high-temperature liquid-phase working fluid separated from the liquid-phase portion in the gas/liquid separator is extracted, the resultant fluid is mixed in a second absorber with high-temperature gas-phase working fluid extracted from an interstage point in the expander to allow liquid-phase working fluid to absorb part of gas-phase working fluid, and the liquid-phase and gas-phase working fluid is used to heat low-temperature liquid-phase working fluid from a condenser in a heater without passing an extracted portion of high-temperature liquid-phase working fluid through the condenser as well as an extracted portion of high-temperature gas-phase working fluid. As a result, the amount of heat exchanged between working fluid and low-temperature heat source in the condenser, therefore the load on the condenser, can be reduced, and the heat of high-temperature liquid-phase working fluid can be recovered appropriately by heat exchange with working fluid directed to the evaporator so as to improve thermal efficiency of the entire cycle.

The vapor power cycle apparatus according to the present invention further includes, as required, one or more heat exchanger to which part of high-temperature gas-phase working fluid extracted from one or more interstage points in the expander is introduced through a path different from a path of a fluid portion toward the second absorber, the heat exchanger allowing the introduced gas-phase working fluid to exchange heat with working fluid from the condenser.

As described above, according to the present invention, part of high-temperature gas-phase working fluid extracted from an interstage point in the expander is allowed to exchange heat in a predetermined heat exchanger with low-temperature liquid-phase working fluid from the condenser separately from a fluid portion flowing through a second absorber to a heater, so as to increase the proportion of fluid bypassing a condenser of working fluid. As a result, the amount of heat exchanged between working fluid and low-temperature heat source in the condenser, therefore the load on the condenser, can be reduced, and the heat of high-temperature liquid-phase working fluid can be recovered appropriately by heat exchange with working fluid directed to the evaporator so as to further improve thermal efficiency of the entire cycle.

DESCRIPTION OF EMBODIMENTS

An embodiment of the present invention will be described with reference to FIG. 1. This embodiment will be describe an exemplary vapor power cycle apparatus in which the working fluid is a mixed medium of ammonia as low boiling-point medium and water as high boiling point medium.

Figure 1:
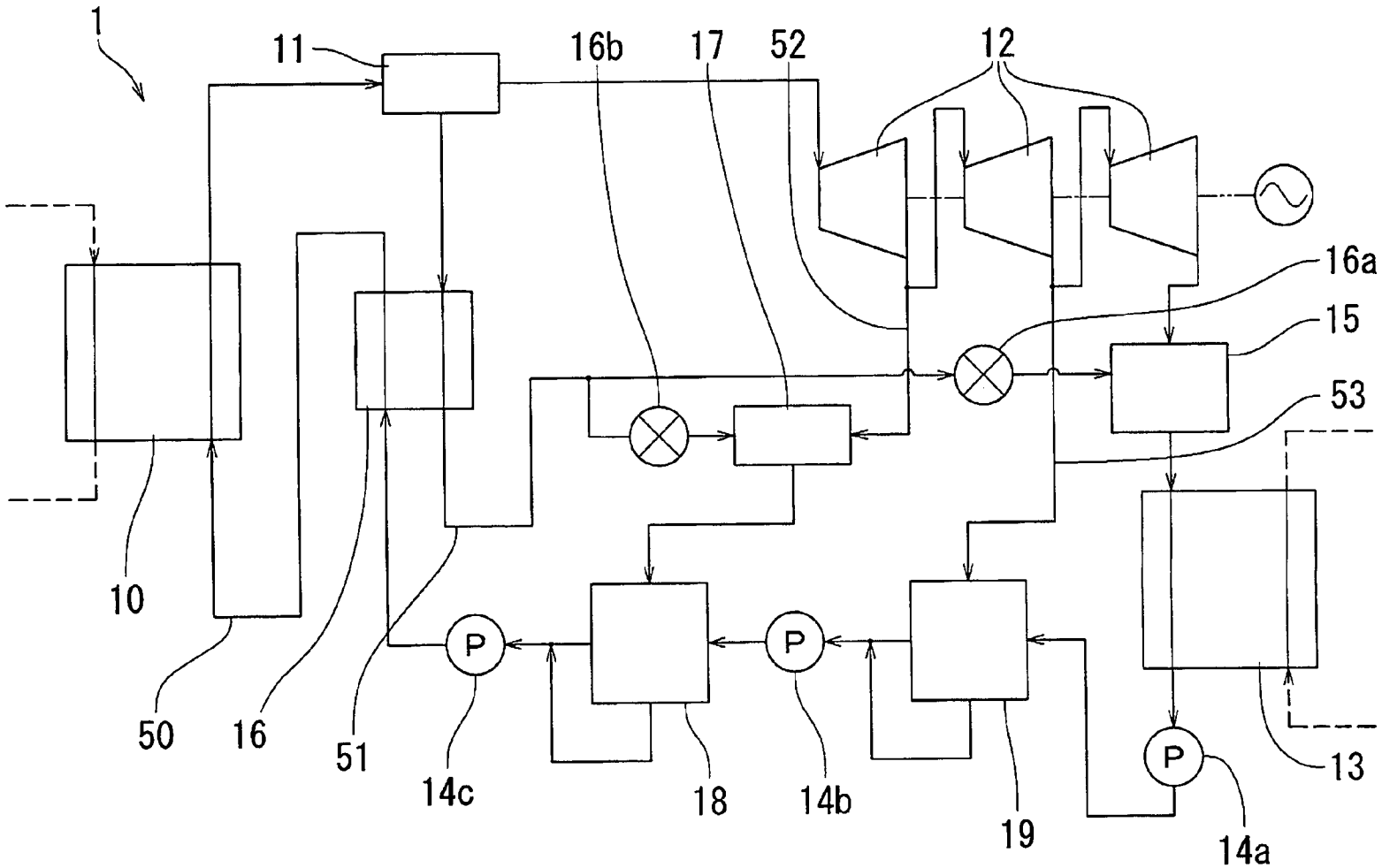
FIG. 1 is a schematic diagram of a vapor power cycle apparatus according to an embodiment of the present invention.

FIG. 1 shows a vapor power cycle apparatus 1 according to the embodiment, which comprises: an evaporator 10 which causes heat-exchange between working fluid composed of mixed medium of ammonia and water and a high-temperature heat source to partially evaporate the working fluid; a gas/liquid separator 11 which separates high-temperature working fluid exiting the evaporator 10 into gas-phase and liquid-phase; a turbine 12 as the expander which operates with high-temperature and gas-phase working fluid; a condenser 13 which condenses high-temperature and gas-phase working fluid exiting the turbine 12; pumps 14*a*, 14*b*, 14*c* as the compressors which direct working fluid exiting the condenser 13 to the evaporator 10; a first absorber 15 which combines high-temperature and gas-phase working fluid exiting the turbine 12 at a previous stage of the condenser 13 and high-temperature and liquid-phase working fluid exiting the gas/liquid separator 11; a regenerator 16 which causes high-temperature and gas-phase working fluid separated in the gas/liquid separator 11 to perform heat-exchange with working fluid exiting the condenser 13; a second absorber 17 which combines part of high-temperature and liquid-phase working fluid exiting the regenerator 16 and partial high-temperature and gas-phase working fluid extracted from the turbine 12; a first heater 18 which causes high-temperature gas-phase and liquid-phase working fluids exiting the second absorber 17 to perform heat-exchange with working fluid exiting the condenser 13; and a second heater 19 which causes heat-exchange between partial high-temperature and gas-phase working fluid extracted from the turbine 12 and working fluid exiting the condenser 13. Among these components, the pumps 14*a*, 14*b*, 14*c* are known pumps similar to those used in conventional vapor power cycles and will not be described in detail herein.

The evaporator 10 has a known structure in that it cause liquid-phase working fluid and a predetermined high-temperature fluid as a high-temperature heat source to flow therein so as to heat-exchange with each other, and will not be described in detail herein. The working fluid inlet side of the evaporator 10 is connected to a primary passage 50, which connected to the condenser 13 through the regenerator 16, the first heater 18, and the pumps 14*a*, 14*b*, 14*c*. The working fluid outlet side of the evaporator is connected to a line that is in communication with the gas/liquid separator 11, and working fluid heated by heat-exchange is introduced to the gas/liquid separator 11.

The gas/liquid separator 11 is a known device that separates working fluid converted to high temperature and liquid/gas mixed phase by heat-exchange in the evaporator 10 into gas-phase and liquid-phase, and will not be described in detail herein. The working fluid is separated into gas-phase and liquid-phase in the gas/liquid separator 11. The high-temperature and gas-phase working fluid moves to the turbine 12 through the line that is in communication with the inlet side of the turbine 12, while the high-temperature and liquid-phase working fluid moves to the regenerator 16 through the line that is in communication with the regenerator 16.

The turbine 12 has a known extraction structure in that it has turbine stages arranged integrally that rotate with expansion of high-temperature and gas-phase working fluid, generates power with the expansion for use in electric power generation or the like, then moves most of the temperature-lowered and pressure-lowered gas-phase working fluid from the final turbine stage to the outlet while part of the gas-phase working fluid can be taken out from between the turbine stages, and will not be described in detail herein. Alternatively, the turbine 12 can be configure so that it is composed of independent devices serving as the respective turbine stages each of which has a different output shaft for drive a different electric generator and extraction is performed from between the devices.

The first absorber 15 is a known heat exchanger that is in communication with the turbine 12 and the regenerator 16 that introduce gas-phase and liquid-phase fluids into the first absorber 15, and passes therethrough a predetermined low-temperature fluid as a low-temperature heat source so that the working fluid and low-temperature fluid heat-exchange with each other, and will not be described in detail herein. The first absorber 15 receives at the same time gas-phase working fluid exiting the turbine 12 and liquid-phase working fluid exiting the regenerator 16, then cooling with heat-exchange is performed so that the gas phase working fluid is partially condensed and part of the gas-phase working fluid is absorbed in the liquid-phase working fluid.

The condenser 13 is a known heat exchanger that is in communication with the first absorber 15 and receives gas-phase and liquid-phase mixed working fluid while passing a predetermined low-temperature fluid as a low-temperature heat source so that the working fluid and the low-temperature fluid heat-exchange with each other, and will not be described in detail herein. The condenser 13 causes gas-phase and liquid-phase working fluids exiting the first absorber 15 to perform heat-exchange with the low-temperature working fluid at the same time so as to cool the liquid-phase working fluid and condense the remaining gas-phase working fluid not absorbed into the first absorber 15. The subsequent stage side of the condenser 13 is connected to the pump 14*a* that delivers liquid-phase working fluid added with the condensed working fluid derived from gas-phase one from the condenser 13 to the subsequent stage side.

The regenerator 16 is a heat exchanger that is interposed in the primary passage 50 for working fluid moving from the condenser 13 through the pumps to the evaporator 10 and causes heat-exchange between liquid-phase working fluid before reaching the evaporator 10 through the primary passage 50 and high-temperature liquid-phase working fluid immediately after separation from gas-phase working fluid in the gas/liquid separator 11. Thus the regenerator 16 is a known heat exchanger having similar structure to the evaporator 10 and the condenser 13, and will not be described in detail herein.

A first branch passage 51 for high-temperature liquid-phase working fluid side, connected to the regenerator 16 and the gas/liquid separator 11, is connected to the first absorber 15 through a pressure reducing valve 16*a*, by which liquid-phase working fluid exiting the regenerator 16 is subject to pressure adjustment and then introduced into the first absorber 15.

The second absorber 17 mixes that part of high-temperature and liquid-phase working fluid moving along the first branch passage 51 extending from the gas/liquid separator 11 through the regenerator 16 to the first absorber 15 which is partially extracted at a predetermined position in the first branch passage 51 after exiting the regenerator 16 with high-temperature gas-phase working fluid that is partially extracted from between the stages of the turbine 12 and moving along the second branch passage 52, and cause liquid-phase working fluid to partially absorb the gas-phase working fluid and delivers it to the first heater 18 at subsequent stage side. A pressure reducing valve 16*b* is disposed in the passage branching from the first branch passage 51 and reaching to the second absorber 17, and liquid-phase working fluid exiting the regenerator 16 is subject to pressure adjustment by the pressure reducing valve 16*b* and then introduced into the second absorber 17.

The first heater 18 is interposed in the primary passage 50 for working fluid moving from the condenser 13 to the evaporator 10 and causes heat-exchange between low-temperature and liquid-phase working fluid at a position in the previous stage side of the regenerator 16 before reaching the regenerator 16 and high-temperature and gas-phase and liquid-phase mixed working fluid after mixing in the second absorber 17. Thus the first heater 18 is a similar heat-exchanger to common feed-water heaters, and will not be described in detail herein.

The second branch passage 52, in communication with the high-temperature working fluid side of the first heater 18, is connected to the primary passage 50 at a position thereof in the subsequent stage side of the first heater 18 and in the previous stage said of the regenerator 16 so that the working fluids flow together, and therefore, working fluid in the second branch passage 52 having been cooled by heat-exchange in the first heater 18 after exiting the second absorber 17 exits the first heater 18 and then is added to liquid-phase working fluid immediately before reaching the regenerator 16.

The first heater 18 may be a typical surface-contact-type heater which causes heat-exchange between high-temperature working fluid in the second branch passage 52 and low-temperature working fluid in the primary passage 50 to perform heat-exchange through the conduction surface. Alternatively, the first heater 18 may be a direct-contact-type heater which causes liquid-phase working fluid in the primary passage 50 and high-temperature working fluid in the second branch passage 52 to flow together for heat-exchange.

The second heater 19 is a heat exchanger that is interposed in the primary passage 50 for working fluid moving from the condenser 13 to the evaporator 10 at a position thereof closer to the condenser 13 than to the first heater 18 and causes heat-exchange between liquid-phase working fluid exiting the condenser 13 and high-temperature gas-phase working fluid partially extracted from between the stages of the turbine 12 and moving through a third branch passage 53. Thus the second heater 19 is a similar heat-exchanger to common feed-water heaters, and will not be described in detail herein. The high-temperature and gas-phase working fluid introduced into the second heater 19 is extracted from an inter-stage position in the turbine 12 that is different from the given inter-stage position thereof from which the working fluid is extracted to be directed to the second absorber 17. The amount of the extracted working fluid introduced into the second heater 19 is less than that of the extracted working fluid directed to the second absorber 17.

Cycle operation of the vapor power cycle apparatus according to the embodiment will be described. In the supposed condition, low-temperature fluid as a low-temperature heat source and high-temperature fluid as a high-temperature heat source is introduced in the apparatus in a sufficient amount to allow heat-exchange by the condenser 13 and the evaporator 10.

In the evaporator 10, heat-exchange is performed between the high-temperature heat source and working fluid. The working fluid after heated by the heat-exchange is converted to gas-phase and liquid-phase mixed one due to the evaporation of part thereof, typically ammonia (having a low boiling point), caused by the raised temperature. This phase-mixed high-temperature working fluid reaches the gas/liquid separator 11 from the evaporator 10.

In the gas/liquid separator 11, the high-temperature working fluid is separated into gas-phase fraction and liquid-phase fraction. The high-temperature gas-phase working fluid exiting the gas/liquid separator 11 moves through the primary passage 50 to the turbine 12. The high-temperature liquid-phase working fluid moves from the gas/liquid separator 11 to the first branch passage 51, moves through the regenerator 16, then moves to the first absorber 15 while being partially tapped for moving into the second absorber 17.

The high-temperature gas-phase working fluid exiting the gas/liquid separator 11 contains as the main component ammonia (about 99%) which has a low boiling-point. Upon the gas-phase working fluid reaching the turbine 12, the turbine 12 starts to operate, then converts the heat-energy to power for driving other apparatuses such as electric generators. The gas-phase working fluid having performed mechanical work by its expansion in the turbine 12 comes to have reduced pressure and temperature, exits the final stage of the turbine 12 while partially removed, and then is introduced into the first absorber 15. Part of high-temperature gas-phase working fluid introduced into the turbine 12 is extracted from between the turbine stages moves into the second branch passage 52 and the third branch passage 53, and the fractions move to the second absorber 17 and the second heater 19, respectively.

On the other hand, the high-temperature liquid-phase working fluid exiting the gas/liquid separator 11 moves into the first branch passage 51, then is introduced into the regenerator 16. In the regenerator 16, heat-exchange is performed between the high-temperature liquid-phase working fluid and another liquid-phase working fluid in the primary passage 50 to raise the temperature of the working fluid in the primary passage 50 and deliver it to the evaporator 10. The liquid-phase working fluid in the first branch passage 51 having been cooled by heat-exchange in the regenerator 16, exits the regenerator 16 and moves through the pressure reducing valve 16*a*, then is introduced into the first absorber 15.

In the first branch passage 51 in the subsequent stage side of the regenerator 16, part of the liquid-phase working fluid is extracted to move to the second absorber 17, in which the introduced partial liquid-phase working fluid flows together with partial gas-phase working fluid extracted from the turbine 12. In the second absorber 17, part of the gas-phase working fluid is absorbed into the liquid-phase working fluid so as to reduce the amount of the gas-phase working fluid reaching the first heater 18 in the subsequent side thereby reducing the thermal conduction area of the first heater 18. Working fluid exiting the second absorber 17 moves through the second branch passage 52 to the first heater 18.

In the first absorber 15, both the gas-phase working fluid exiting the final stage of the turbine 12 and introduced thereinto and the liquid-phase working fluid introduced thereinto perform heat-exchange with the low-temperature heat source resulting in the whole fluid being cooled, and the gas-phase working fluid comes to contact with the liquid-phase working fluid so as to be partially absorbed thereinto and change to liquid-phase.

The remaining, not absorbed gas-phase working fluid moves to the condenser 13 along with the liquid-phase working fluid, and thus, these working fluids in the gas-phase and liquid-phase mixed state are introduced to the condenser 13.

In the condenser 13, the gas-phase working fluid and liquid-phase working fluid introduced thereinto perform heat-exchange with a low-temperature heat source that is introduced independently from these fluids, resulting in the whole fluid being cooled, and the gas-phase working fluid is condensed into liquid-phase due to cooling by the heat-exchange. The working fluid thus entirely converted to liquid-phase is discharged from the condenser 13 to the outside, moves through the pump 14 along the primary passage 50 toward the evaporator 10, and reaches the second heater 19.

Into the second heater 19, partial gas-phase working fluid extracted from the turbine 12 is introduced through the third branch passage 53, and this high-temperature and gas-phase working fluid and liquid-phase working fluid coming through the primary passage 50 perform heat-exchange in the second heater 19. In the second heater 18, the temperature of the liquid-phase working fluid in the primary passage 50 is raised to recover the heat of high-temperature working fluid in the third branch passage 53. The high-temperature and gas-phase working fluid in the third branch passage 53 is cooled by heat-exchange in the second heater 19 to be condensed into liquid-phase, so that pressure and temperature are decreased. The working fluid in the third branch passage 53 having experienced heat-exchange exits the second heater 19, and then is added to low-temperature working fluid flowing through the primary passage 50 at the connecting point of the third branch passage 53 and the primary passage 50. The resultant working fluid after the addition moves through the pump 4*b* and reaches the first heater 18.

The first heater 18 also passes therethrough phase-mixed fluid composed of high-temperature and gas-phase working fluid and high-temperature and liquid-phase working fluid introduced from the second absorber 17 through the second branch passage 52, and the high-temperature, gas-phase and liquid-phase working fluids perform heat-exchange with the liquid-phase working fluid coming through the primary passage 50 in the first heater 18. In the first heater 18, the temperature of the liquid-phase working fluid in the primary passage 50 is raised to recover the heat of high-temperature working fluid in the second branch passage 52. Among the high-temperature working fluids in the second branch passage 52, the gas-phase working fluid is cooled by heat-exchange in the first heater 18 to be condensed into liquid-phase, so that pressure and temperature are decreased. The working fluid in the second branch passage 52 having experienced heat-exchange exits the first heater 18, and then is added to low-temperature working fluid flowing through the primary passage 50 at the connecting point of the second branch passage 52 and the primary passage 50. The resultant working fluid after the addition moves through the pump 4*c* to the regenerator 16.

Thus, the liquid-phase working fluid exiting the condenser 13 experiences heat-exchanges in the second heater 19, the first heater 18 and the regenerator 16, and returns to the evaporator 10 in the state of the predetermined raised temperature, so that it repeats the steps after the heat-exchange in the evaporator 10 as described above.

Thus, in the vapor power cycle apparatus according to the embodiment, part of the high-temperature liquid-phase working fluid that is separated from the gas-phase working fluid in the gas/liquid separator 11 is extracted and then mixed with high-temperature and gas-phase working extracted from between the stages of the turbine 12 in the second absorber 17, causing the liquid-phase working fluid to absorb part of the gas-phase working fluid; the high-temperature and liquid-phase working fluid and the high-temperature and gas-phase working fluid is used to heat low-temperature and liquid-phase working fluid in the first heater 18; neither the extracted fraction of the high-temperature and gas-phase working fluid nor the fraction partially extracted from the high-temperature and liquid-phase working fluid moves through the condenser 13, so that the amount of heat-exchange between the working fluid and the low-temperature heat source can be reduced thereby reducing the load on the condenser 13 and that the heat of the high-temperature and liquid-phase working fluid is adequately recovered by heat-exchange with the working fluid moving to the evaporator 10 thereby improving the thermal efficiency of the whole cycle.

In the embodiment, the vapor power cycle apparatus has the configuration in which extraction is performed at two stages of the turbine 12, and the extracted high-temperature and gas-phase working fluids are introduced into the second absorber 17 and the second heater 19, respectively. However, the configuration of the vapor power cycle apparatus is not limited to that, and rather, the vapor power cycle apparatus can also have a configuration in which extraction from the turbine is performed at more stages, and additional heat exchangers similar to the second heater are provided so as to perform at multiple stages the heat-exchange between the high-temperature and gas-phase working fluid and the liquid-phase working fluid exiting from the condenser.

Figure 2:
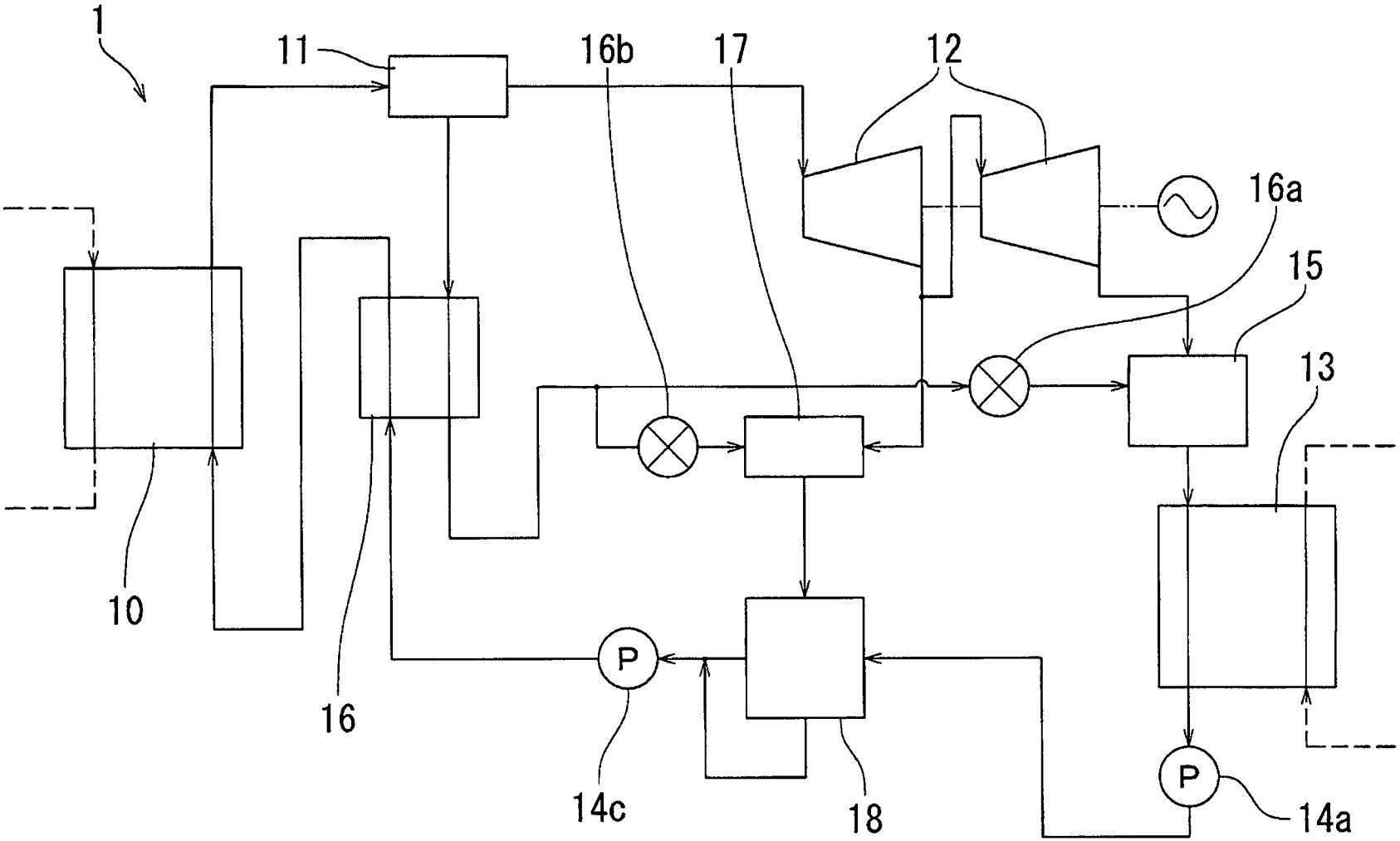
FIG. 2 is a schematic diagram of a vapor power cycle apparatus according to another embodiment of the present invention.

Alternatively, the vapor power cycle apparatus can also have a configuration without the second heater, as shown in FIG. 2, in which extraction from the turbine 12 is performed at a single stage and the extracted gas-phase working fluid is introduced only into the second absorber 17. In this way, it is possible to provide power cycles that allow suitable adjustment of the proportion of the working fluids to perform mechanical works at expanders such as turbines depending on the applications.

EXAMPLE

The thermal efficiency was determined for a vapor power cycle apparatus according to the present invention considering the amount of heat transferred into and out of the apparatus, pressure, and other conditions, and the results are evaluated by comparing them with a conventional vapor power cycle, which is a comparative example.

Figure 3:
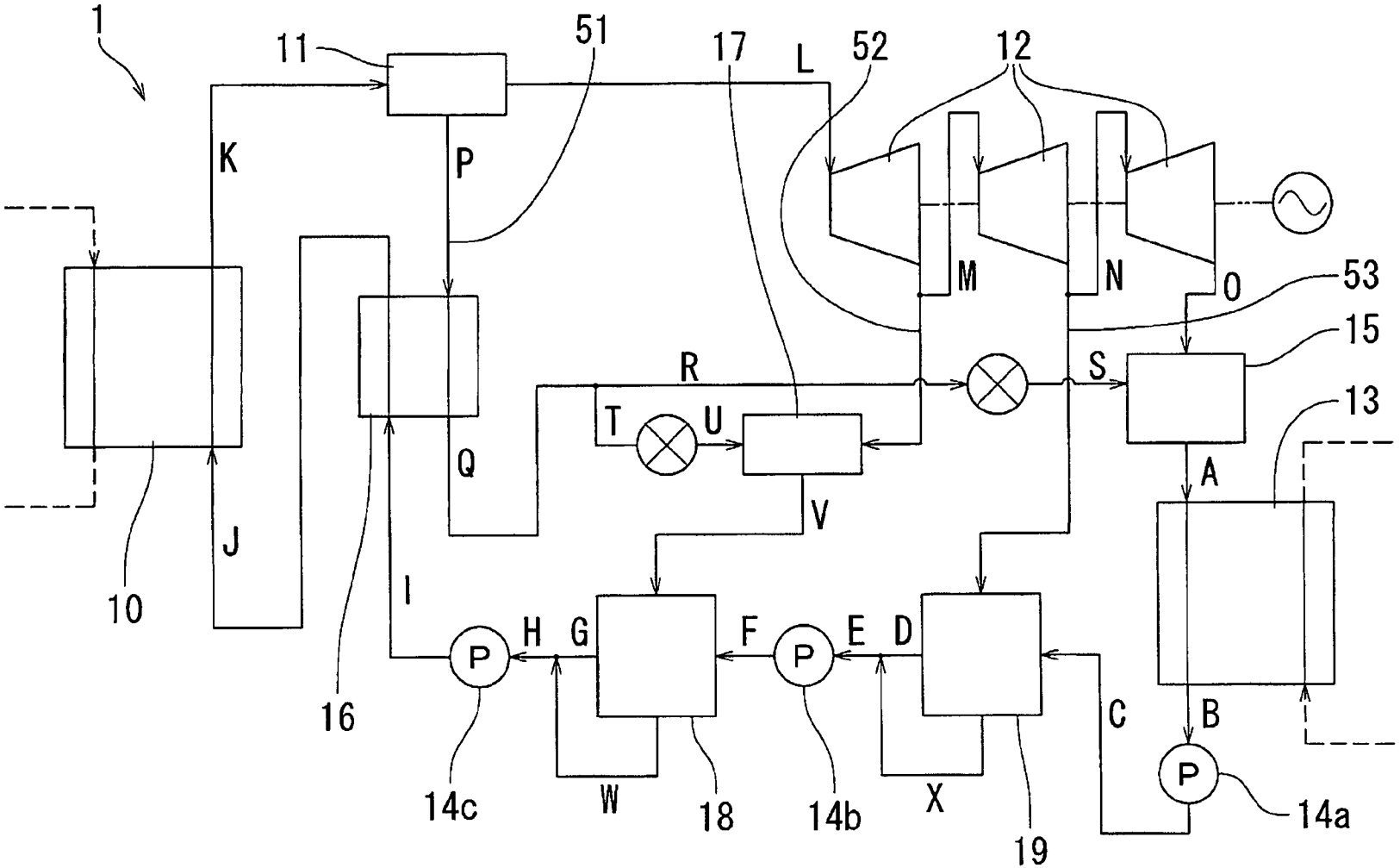
FIG. 3 is a schematic diagram of an example of a vapor power cycle apparatus according to the present invention.

Similarly to the embodiments, the vapor power cycle apparatus according to the present invention of this example uses, as the working fluid, a mixed medium of ammonia as low boiling point medium and water as high boiling point medium. The apparatus has the two-stage extraction configuration as shown in FIG. 3, and exchanges heat with the liquid-phase working fluid by introducing part of turbine bleed into the second heater 19. The conditions such as pressure and temperature of the working fluid were determined at each of the cycle points A to X as shown in FIG. 3 and then the theoretical thermal efficiency was determined.

The primary conditions associated with the cycle of the example were set as follows: the inlet temperature on the high-temperature heat source side of the evaporator 10 was 80° C., the outlet temperature thereof was 70° C., and the evaporator outlet temperature (at the point K) of the working fluid that exchanges heat in the evaporator was 76° C. On the other hand, the inlet temperature on the low-temperature heat source side of the condenser 13 was set to 20° C., the outlet temperature thereof was 24° C., and the condenser outlet temperature (at the point B) of the working fluid that exchanges heat in the condenser was 21° C.

Here, the maximum pressure, that is, the pressure at the inlet of the turbine 12 (at the point L) of the working fluid was specified to $2.00\times10^6$ Pa. The concentration of ammonia of the working fluid was 63%.

The liquid-phase portion K) of the working fluid that flows into the first branch passage 51 (at the point P) after it is separated from the gas-phase portion in the gas/liquid separator 11 was 97.1% of the entire working fluid. Furthermore, 82% of the liquid-phase working fluid flowing through the first branch passage 51 (79.7% of the entire working fluid) was directed to the first absorber 15 ($\zeta_1$) and the rest of the liquid-phase working fluid ($\zeta_2$) was directed to the second absorber 17.

Part of the gas-phase working fluid introduced to the turbine 12 was extracted; one part ($\omega_1$) of the extracted fluid that was introduced to the second branch passage 52 and directed to the second absorber 17 was 0.436% of the entire working fluid and the other part ($\omega_2$) that was introduced to the third branch passage 53 and directed to the second heater 19 was 0.100% of the entire working fluid.

Table 1 shows calculated values of pressure P of the working fluid, temperature T, molality of ammonia W, working fluid density RHO, and enthalpy h at each of the cycle points A to X based on the conditions as described above.

TABLE 1

| Point | P (MPa) | T (° C.) | W | RHO (kg/m$^3$) | h (kJ/kg) |
|---|---|---|---|---|---|
| A | 0.46322 | 22.068 | 0.6299 | 112.63 | 114.57 |
| B | 0.46322 | 21.000 | 0.6299 | 779.09 | 75.36 |
| C | 0.78400 | 21.030 | 0.6299 | 779.21 | 75.77 |
| D | 0.78400 | 21.343 | 0.6299 | 778.93 | 77.21 |
| E | 0.78400 | 21.366 | 0.6303 | 778.73 | 77.45 |
| F | 1.27570 | 21.412 | 0.6303 | 778.90 | 78.08 |
| G | 1.27570 | 23.081 | 0.6303 | 777.42 | 85.72 |
| H | 1.27570 | 23.793 | 0.6300 | 776.92 | 88.87 |
| I | 2.00000 | 23.864 | 0.6300 | 777.17 | 89.80 |
| J | 2.00000 | 74.577 | 0.6300 | 715.95 | 326.61 |
| K | 2.00000 | 76.000 | 0.6300 | 287.87 | 365.45 |
| L | 2.00000 | 76.000 | 0.9943 | 13.45 | 1583.57 |
| M | 1.27570 | 48.943 | 0.9943 | 9.23 | 1519.02 |
| N | 0.78400 | 23.071 | 0.9943 | 6.16 | 1454.47 |
| O | 0.46322 | 4.405 | 0.9943 | 3.91 | 1389.92 |
| P | 2.00000 | 76.000 | 0.6193 | 719.24 | 329.66 |
| Q | 2.00000 | 21.866 | 0.6193 | 783.40 | 77.44 |
| R | 2.00000 | 21.866 | 0.6193 | 783.40 | 77.44 |
| S | 0.46322 | 22.155 | 0.6193 | 782.47 | 77.44 |
| T | 2.00000 | 21.866 | 0.6193 | 783.40 | 77.44 |
| U | 1.27570 | 22.002 | 0.6193 | 782.96 | 77.44 |
| V | 1.27570 | 29.051 | 0.6284 | 772.63 | 112.45 |
| W | 1.27570 | 21.366 | 0.6284 | 774.56 | 103.29 |
| X | 0.78400 | 17.416 | 0.9943 | 616.84 | 277.26 |

Figure 4:
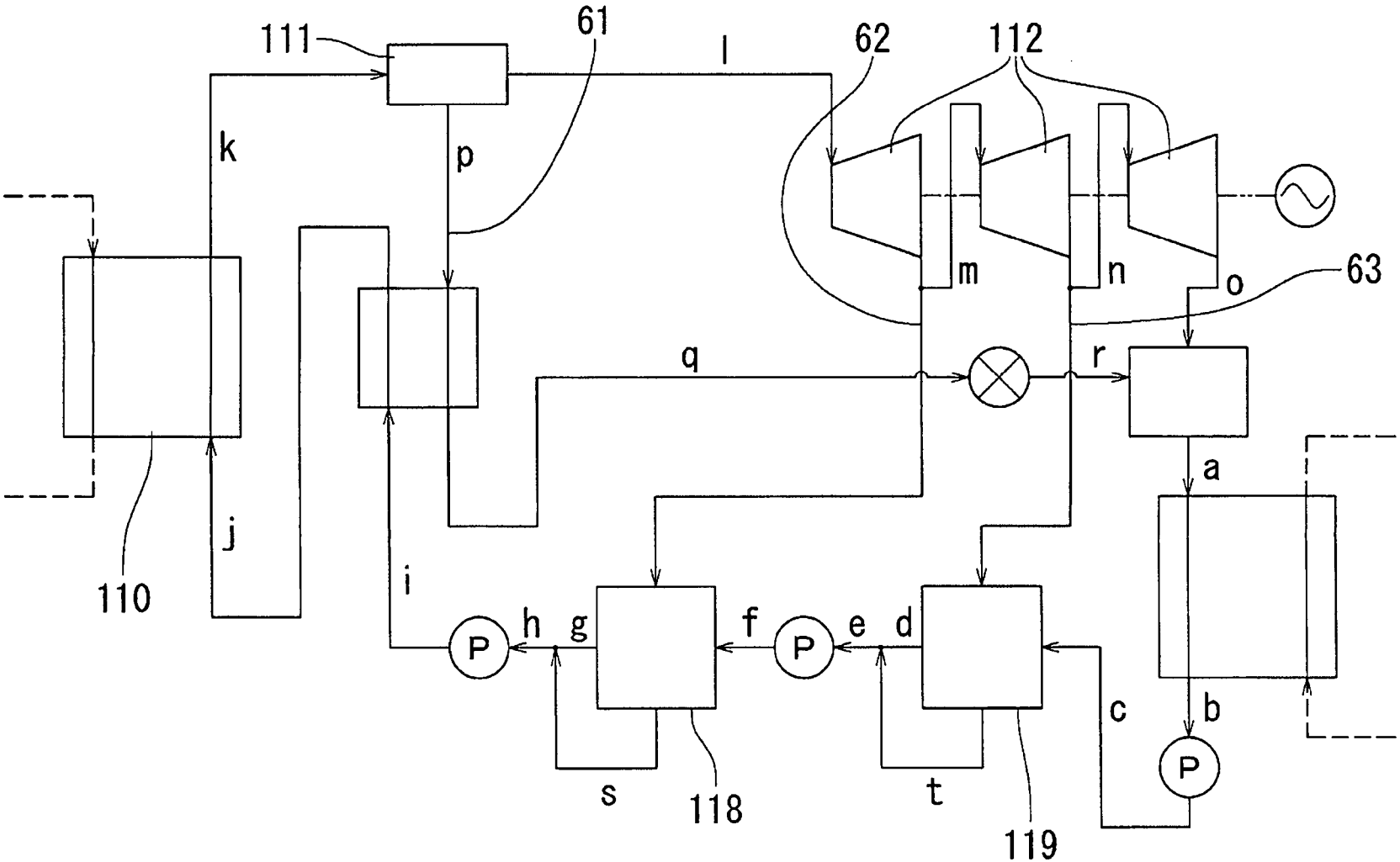
FIG. 4 is a schematic diagram of a conventional vapor power cycle apparatus.

As a comparative example, the conditions such as pressure and temperature of the working fluid were determined at each of the cycle points "a" to "t" as shown in FIG. 4 and then the theoretical thermal efficiency was determined, similarly to the above-described example, for a mixed medium cycle apparatus having a conventional two-stage extraction configuration (see FIG. 4) similar to the configuration according to the present invention, except that the entire amount of the liquid-phase working fluid flowing through the first branch passage 51 was directed to the first absorber 15 and extracted gas-phase working fluid was directly introduced to the first heater 18 without the intermediate second absorber.

In this case, the maximum pressure of the working fluid, temperature conditions of the high-temperature heat source and the low-temperature heat source, and the evaporator 110 outlet temperature of the working fluid were the same as the set values for the apparatus according to the present invention.

One different condition was the concentration of ammonia in the working fluid, which was 70%.

The liquid-phase portion ($\zeta$) of the working fluid that flows into the first branch passage 61 (at the point p) after it is separated from the gas-phase portion in the gas/liquid separator 111 was 78.5% of the entire working fluid. Of the gas-phase working fluid introduced to the turbine 112, one part ($\omega_l$) of the extracted fluid that was introduced to the second branch passage 62 and directed to the first heater 118 was 0.11% of the entire working fluid and the other part ($\omega_2$) that was introduced to the third branch passage 63 and directed to the second heater 119 was 0.099% of the entire working fluid.

Table 2 shows calculated values of pressure P of the working fluid, temperature T, molality of ammonia W, working fluid density RHO, and enthalpy h at each of the cycle points "a" to "t" based on the conditions as described above.

TABLE 2

| Point | P (MPa) | T (° C.) | W | RHO (kg/m$^3$) | h (kJ/kg) |
|---|---|---|---|---|---|
| a | 0.57444 | 28.134 | 0.6994 | 20.58 | 387.31 |
| b | 0.57444 | 21.000 | 0.6994 | 749.49 | 102.46 |
| c | 0.89630 | 21.037 | 0.6994 | 749.59 | 102.89 |
| d | 0.89630 | 21.288 | 0.6994 | 749.34 | 104.05 |
| e | 0.89630 | 21.301 | 0.6997 | 749.20 | 104.24 |
| f | 1.35725 | 21.354 | 0.6997 | 749.34 | 104.85 |
| g | 1.35725 | 21.692 | 0.6997 | 748.99 | 106.42 |
| h | 1.35725 | 21.995 | 0.7000 | 748.54 | 107.96 |
| i | 2.00000 | 22.071 | 0.7000 | 748.73 | 108.82 |
| j | 2.00000 | 58.068 | 0.7000 | 704.27 | 277.39 |
| k | 2.00000 | 76.000 | 0.7000 | 58.50 | 599.49 |
| l | 2.00000 | 76.000 | 0.9943 | 13.45 | 1583.57 |
| m | 1.35725 | 52.639 | 0.9943 | 9.71 | 1527.63 |
| n | 0.89630 | 29.328 | 0.9943 | 6.89 | 1471.69 |
| o | 0.57444 | 11.237 | 0.9943 | 4.72 | 1415.76 |
| p | 2.00000 | 76.000 | 0.6193 | 719.24 | 329.66 |
| q | 2.00000 | 28.570 | 0.6193 | 777.29 | 108.05 |
| r | 0.57444 | 28.822 | 0.6193 | 776.43 | 108.05 |
| s | 1.35725 | 21.301 | 0.9943 | 9.83 | 1519.05 |
| t | 0.89630 | 21.586 | 0.9943 | 610.18 | 297.11 |

Based on the conditions of the working fluid at each of the cycle points shown in Table 1, the theoretical thermal efficiency $\eta_{th}$ of the example can be expressed in the following expression:

$$\eta_{th}=1-Q_L/Q_H=1-(1-\omega_1-\omega_2-\zeta_2)(h_A-h_B)/(h_K-h_J)=0.172.$$

On the other hand, based on the conditions of the working fluid at each of the cycle points shown in Table 2, the theoretical thermal efficiency $\eta_{th}$ of the comparative example, or the conventional cycle apparatus, can be expressed in the following expression:

$$\eta_{th}=1-Q_L/Q_H=1-(1-\omega_1-\omega_2)(h_a-h_b)/(h_k-h_j)=0.117.$$

As described above, it is apparent that the vapor power cycle according to the present invention provides excellent efficiency over a conventional mixed medium stream power cycle, and has a second absorber for allowing extracted gas-phase working fluid at high temperature to be absorbed to liquid-phase working fluid, which facilitates efficient use of the temperature difference between a high-temperature heat source and a low-temperature heat source.

Reference Signs List

| | |
|---|---|
| 1 | vapor power cycle apparatus |
| 10, 110 | evaporator |
| 11, 111 | gas/liquid separator |
| 12, 112 | turbine |
| 13 | condenser |
| 14a, 14b, 14c | pump |
| 15 | first absorber |
| 16 | regenerator |
| 16a, 16b | pressure reducing valve |
| 17 | second absorber |
| 18, 118 | first heater |
| 19, 119 | second heater |
| 50 | primary passage |
| 51, 61 | first branch passage |
| 52, 62 | second branch passage |
| 53, 63 | third branch passage |

The invention claimed is:

1. A vapor power cycle apparatus comprising at least:

an evaporator for allowing working fluid to exchange heat with a predetermined high-temperature heat source and for evaporating at least part of the working fluid, the working fluid including a plurality of materials each having different boiling point mixed with each other;

a gas/liquid separator for separating a high-temperature working fluid obtained from the evaporator into a gas-phase portion and a liquid-phase portion;

an expander that receives the gas-phase portion of high-temperature working fluid for converting heat energy of the working fluid into power;

a condenser for allowing a high-temperature gas-phase working fluid from the expander and mixed with the liquid-phase portion from the gas/liquid separator to exchange heat with a predetermined low-temperature source; and a compressor for compressing the working fluid from the condenser and directing the working fluid to the evaporator, the expander including a plurality of expansion stages, and part of high-temperature gas-phase working fluid being extracted from one or more interstage points, the vapor power cycle apparatus further comprising:

a regenerator for allowing a high-temperature liquid-phase working fluid separated in the gas/liquid separator to exchange heat with working fluid flowing from the compressor toward the evaporator;

a first absorber for combining the high-temperature gas-phase working fluid from a last stage of the expander with a part of a high-temperature gas-phase working fluid flowing through the regenerator from the gas/liquid separator, and for allowing a high-temperature liquid-phase working fluid to absorb the part of the high-temperature gas-phase working fluid and directing a resultant fluid to the condenser;

a second absorber for combining a remaining portion of the high-temperature gas-phase working fluid flowing through the regenerator with at least a part of the high-temperature gas-phase working fluid extracted from the expander, and for allowing high-temperature liquid-phase working fluid to absorb the part of high-temperature gas-phase working fluid; and a heater for allowing the high-temperature gas-phase and liquid-phase working fluid flowing therethough from the second absorber to heat the working fluid flowing from the condenser, through the heater and towards the regenerator, the high-temperature gas-phase and liquid-phase working fluid and the working fluid being isolated from one another as each one flows through the heater, the working fluid after being heated by heat-exchange in the heater is combined with the high-temperature gas-phase and liquid-phase working fluid after exiting the heater to form a liquid-phase working fluid flowing to and through the regenerator and subsequently though a primary passage interconnecting the regenerator and the evaporator.

2. The vapor power cycle apparatus according to claim 1, further comprising:

one or more heat exchangers to which a part of the high-temperature gas-phase working fluid extracted from one or more interstage points in the expander is introduced through a path different from a path of a fluid portion toward the second absorber, the heat exchanger allowing the introduced gas-phase working fluid to exchange heat with working fluid from the condenser.

* * * * *